US006371002B1

(12) United States Patent
MacLeod

(10) Patent No.: US 6,371,002 B1
(45) Date of Patent: Apr. 16, 2002

(54) DETACHABLE SHOCK-ABSORBING RAM-PLATE

(75) Inventor: Brenda Brennan MacLeod, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 5 days.

(21) Appl. No.: 09/672,800

(22) Filed: Sep. 29, 2000

(51) Int. Cl.[7] ..... F41F 3/04
(52) U.S. Cl. ..... 89/1.81; 89/1.816
(58) Field of Search ..... 89/1.81, 1.818, 89/1.816

(56) References Cited

U.S. PATENT DOCUMENTS 4,406,211 A * 9/1983 Andersen
4,426,755 A * 1/1984 Figone
4,627,327 A * 12/1986 Huber
4,646,617 A * 3/1987 Robinson
5,945,628 A * 8/1999 Roheim
6,164,179 A * 12/2000 Buffman
6,242,684 B1 * 6/2001 Oliver

FOREIGN PATENT DOCUMENTS

DE 4112778 * 10/1992

* cited by examiner

*Primary Examiner*—Peter M. Poon
*Assistant Examiner*—Troy Chambers
(74) *Attorney, Agent, or Firm*—Michael J. McGowan; Robert W. Gauthier; Prithvi C. Lall

(57) ABSTRACT

The detachable shock-absorbing ram-plate is used in a projectile launching system to mitigate launching impact forces and to prevent ram-plate re-strike during launch. The detachable shock-absorbing ram-plate is detachably coupled to the projectile using break-away fasteners that allow the ram-plate to be attached to the projectile during launch and detached from the projectile at the end of the launch. One embodiment of the detachable shock-absorbing ram-plate is a single impact, viscous fluid ram-plate including a cylinder, a perforated piston, and a viscous fluid disposed between the cylinder and the perforated piston. Upon receiving a high initial launch impact force, the piston compresses causing the viscous fluid to be forced through the perforated piston, thereby absorbing the shock of the initial launching impact force. Another embodiment of the detachable shock-absorbing ram-plate is a gas spring ram-plate having a cylinder and piston that compresses a gas to absorb shock caused by launching forces. A further embodiment of the shock-absorbing ram-plate is made from a compressible elastic material.

15 Claims, 2 Drawing Sheets

DETACHABLE SHOCK-ABSORBING RAM-PLATE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field Of The Invention

The present invention relates to the launching of projectiles and more particularly, to a detachable shock-absorbing ram-plate used to absorb the shock caused by launching impact forces.

2. Description Of The Prior Art

Launchers are used to launch projectiles, such as torpedoes, missiles, countermeasures, and other underwater devices. Ram-plates can be used to protect the projectile from the charge explosion and to prevent blow-by of launch fluids during launch. Currently, ram-plates used for such launchers are made of solid metal and are designed to transmit forces rigidly rather than mitigate those forces. For certain launching systems, the projectiles experience a large initial launch impulse that requires the projectiles to be designed to very high standards to avoid damage.

Also, the existing ram-plates are not attached to the projectiles. As a result, spring like dynamics during some launches may cause the ram-plate to separate from the projectile and then re-strike the projectile once the propulsive launch force recovers. Such ram-plate re-strike has potential to damage some projectiles.

SUMMARY OF THE INVENTION

Accordingly, one object of the present invention is to reduce shock to the projectile using a shock-absorbing ram-plate without requiring significant modification of the propulsive launch mechanism.

Another object of the present invention is to prevent damage to the projectile due to ram-plate re-strike during launch by preventing separation of the ram-plate from the projectile during launch dynamics.

The present invention features a projectile launching system comprising a launch tube, a projectile disposed in the launch tube, a shock-absorbing ram-plate, and a break-away fastener removably fastening the shock-absorbing ram-plate to the projectile. The shock-absorbing ram-plate compresses to absorb impact forces caused by launching. The break-away fastener has strength sufficient to withstand the impact forces but insufficient to prevent detachment of the shock-absorbing ram-plate proximate an end of the launching tube at the end of the launch. The break-away fastener can include a snap, a pin, a screw, a bolt, a cable, or the like. The launch tube includes a stopping structure for stopping the shock-absorbing ram-plate proximate the end of the launch tube such that the break-away fastener fails causing the shock-absorbing ram-plate to remain in the launch tube while the projectile is launched.

The present invention also features a single-impact viscous fluid ram-plate comprising a cylinder defining a cavity and a piston positioned within the cavity of the cylinder. The piston includes at least one aperture extending therethrough. A viscous fluid is disposed in the cavity between the cylinder and the piston. The viscous fluid is forced out of the aperture in the piston when an initial impact force acts on the piston such that the piston and the cylinder are compressed.

In another embodiment, the detachable shock-absorbing ram-plate includes a piece of elastic material. In a further embodiment, the detachable shock-absorbing ram-plate includes a cylinder defining a cavity, a piston positioned within the cavity of the cylinder, and a gas disposed in the cavity between the cylinder and the piston. The piston compresses the gas upon receiving launching impact forces.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
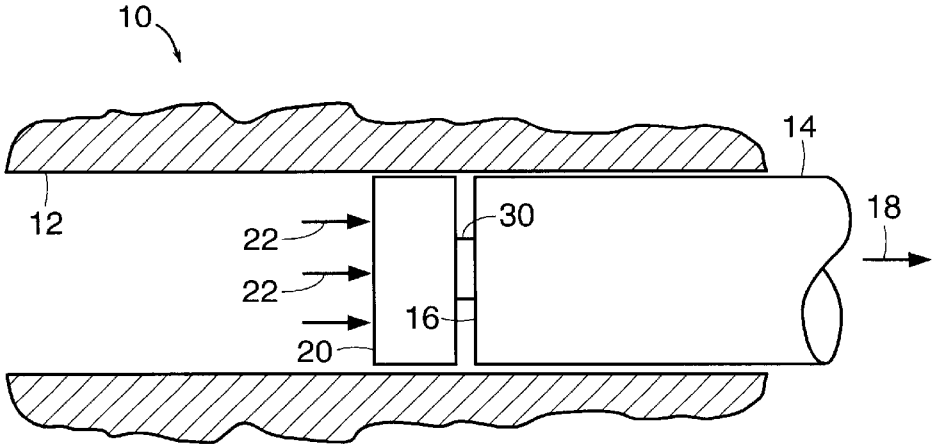
FIG. 1 is a partially cross-sectional view of the projectile launching system, according to the present invention, at the beginning of a launch.
Figure 2:
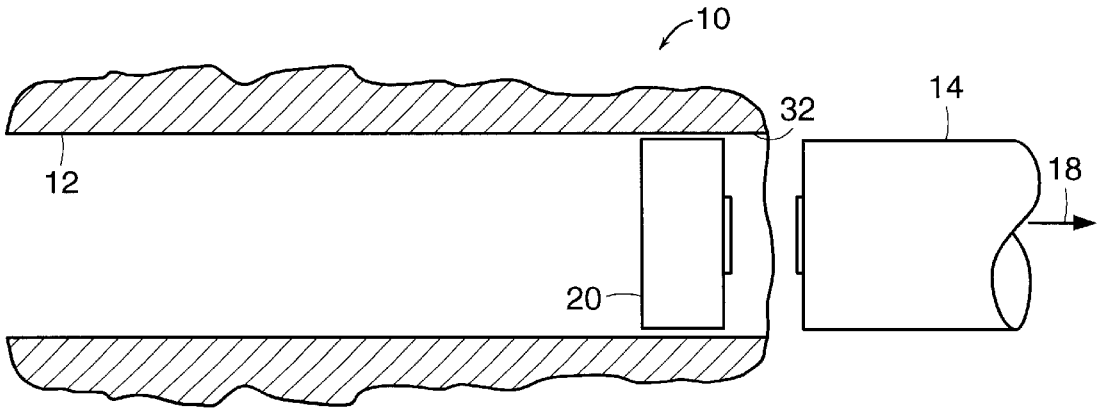
FIG. 2 is a partially cross-sectional view of the projectile launching system at the end of a launch.

The projectile launching system 10, FIGS. 1 and 2, according to the present invention, includes a launch tube 12 and a projectile 14. The projectile 14 can be any type of projectile including, but not limited to, a torpedo, missile, counter measure, and other underwater devices. A propulsive launch mechanism (not shown) causes propulsive launch forces to propel the projectile 14 down the launch tube 12 in the direction of arrow 18. Any type of propulsive launch mechanism can be used in connection with the present invention. Preferably, the launch mechanism uses fluids, i.e., high pressure gas or moving liquids, to eject the projectile 14.

A detachable shock-absorbing ram-plate 20 is detachably coupled to an end 16 of the projectile 14. The shock-absorbing ram-plate 20 absorbs launching impact forces, designated by arrows 22, caused by the launching mechanism to reduce shock to the projectile 14 when the projectile 14 is propelled down the launch tube 12. Absorbing the shock of launching impact forces 22 prevents damage to the projectile 14 as a result thereof.

One or more break-away fasteners 30 detachably couple the detachable shock-absorbing ram-plate 20 to the projectile 14. The break-away fasteners 30 can include snaps, pins, screws, bolts, or cables. The break-away fasteners 30 tightly attach the ram-plate 20 to the projectile 14 and have sufficient strength to prevent detachment as a result of launching impact forces, but are designed to fail when the ram-plate 20 is stopped at the end of the launch tube 12. For example, stopping forces on the ram-plate causes snaps to unsnap, internal or external threads in screws or bolts to fail, and pins and cables to break. If a cable is used as the break-away fastener 30, the cable is tensioned upon installation to ensure that there is a force holding the ram-plate 20 to the projectile 14 even if the cable stretches.

The launch tube 12 preferably includes a stopping structure 32 (FIG. 2) proximate an end of the launch tube 12 to stop the ram-plate 20. Although the exemplary embodiment shows a taper that captures and stops the ram-plate 20, any type of structure capable of stopping the ram-plate 20 can be used. As seen in FIG. 2, when ram-plate 20 contacts stopping structure 32, projectile 14 separates from ram-plate 20. Detachably fastening the ram-plate 20 to the projectile 14 prevents ram-plate separation and thus prevents damage to the projectile 14 caused by ram-plate re-strike. The break-away fasteners 30 can typically be installed without requiring extra modification of the ram-plate 20 and projectile 14.

Although specific types of break-away fasteners are disclosed herein, the present invention can use any method of temporarily attaching the ram-plate 20 to the projectile 14 during the launch such that the ram-plate 20 detaches at the end of the launch.

Figure 3:
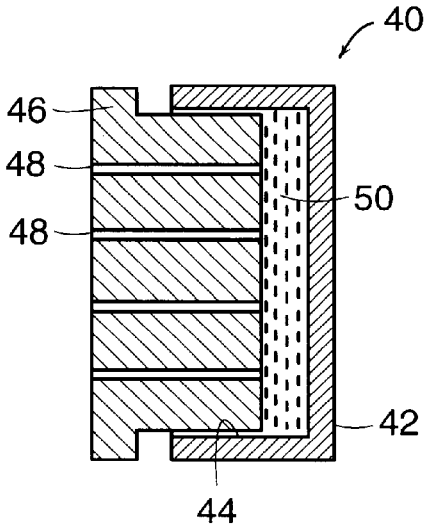
FIG. 3 is a cross-sectional view of a single impact viscous fluid ram-plate, according to one embodiment of the present invention, prior to impact.
Figure 4:
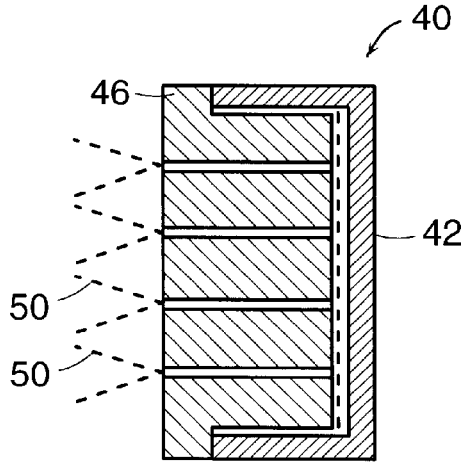
FIG. 4 is a cross-sectional view of the single impact viscous fluid ram-plate after impact.

According to one embodiment shown in FIGS. 3 and 4, the shock-absorbing ram-plate is a single impact, viscous fluid ram-plate 40 that compresses upon receiving an excessive impulse imparted by the propulsive mechanism. The single impact, viscous fluid ram-plate 40 comprises a cylinder 42 defining a cavity 44 and a perforated piston 46 including one or more apertures 48 extending therethrough. The piston 46 is positioned within the cavity 44 and is separated from the cylinder 42 by a hermetically sealed viscous fluid 50. In the preferred embodiment, the cylinder 42, piston 46, and viscous fluid 50 are all generally disc shaped. The cylinder 42 and piston 46 are preferably made of a metal material and are initially attached to each other with a weak adhesive between the walls of the cylinder 42 and piston 46.

As a result of an initial launching impact force, the piston 46 compresses the viscous fluid 50 causing the hermetic seal to fail and the viscous fluid 50 to be forced out of the cavity 44 through the apertures 48 in the piston 46 (see FIG. 4). The viscous fluid 50 is preferably a relatively inert substance so that no undesirable side effects will result from being released during the initial launching impact force. This single impact, viscous fluid ram-plate 40 protects against excessive launch impulse and thus is designed to mitigate a high initial launch impulse. In one embodiment, the outer diameter of the piston 46 has a slight taper, and the cylinder 42 and piston 46 are formed such that the piston 46 engages cylinder 42 as piston 46 advances in cavity 44. Thus, when completely engaged, ram-plate 40 transmits force in a rigid fashion to prevent ram-plate separation and damage caused by ram-plate restrike.

Figure 5:
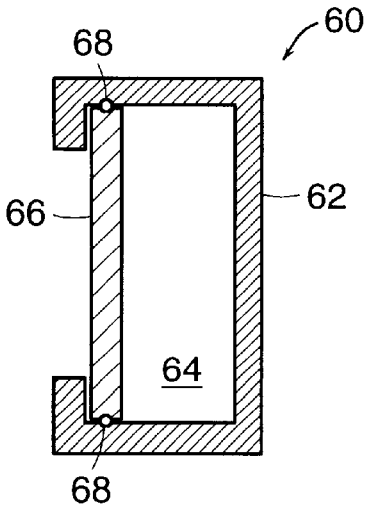
FIG. 5 is a cross-sectional view of a gas spring ram-plate, according to another embodiment of the present invention.

According to another embodiment shown in FIG. 5, the shock-absorbing ram-plate is a gas spring ram-plate 60 comprising a cylinder 62 defining a cavity 64 and a piston 66 slidably disposed within the cavity 64. The cavity 64 contains air or some other gas. An o-ring 68, or other type of seal, prevents the gas from escaping from cylinder 62. Upon receiving a launching impact force, the piston 66 compresses the gas, and after the shock is absorbed, the piston 66 returns to an equilibrium position. This gas spring ram-plate 60 mitigates propulsive shocks as well as preventing damage due to ram-plate re-strike should the ram-plate 60 become detached during the launch.

Figure 6:
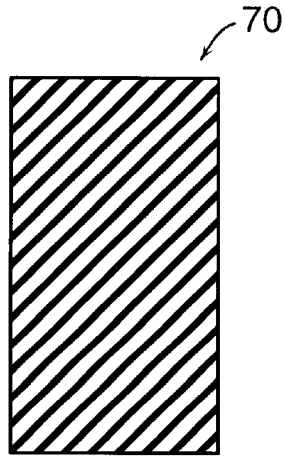
FIG. 6 is a cross-sectional view of an elastic material ram-plate, according to a further embodiment of the present invention.

According to a further embodiment shown in FIG. 6, the shock-absorbing ram-plate is an elastic material ram-plate 70. The elastic material ram-plate 70 compresses as a result of the launching impact force and then decompresses after the shock is absorbed. This type of elastic material ram-plate 70 also mitigates propulsive shocks as well as preventing damage due to ram-plate re-strike should the ram-plate 70 become detached during the launch.

Although three embodiments of the shock-absorbing ram-plate are disclosed herein, other types of shock-absorbing ram-plates can also be used including variations on hydraulic, pneumatic, and solid shock absorbers.

In light of the above, it is therefore understood that within the scope of the appended claims, the invention may be practiced otherwise than as specifically described.

What is claimed is:

1. A detachable shock-absorbing ram-plate for use in launching projectiles, comprising:

a shock-absorbing ram-plate, wherein said shock-absorbing ram-plate compresses to absorb launching impact forces caused by launching; and a break-away fastener for removably fastening said shock-absorbing ram-plate to a launch force applied end of the projectile, wherein said break-away fastener has strength sufficient to withstand said launching impact forces but insufficient to prevent detachment of said shock-absorbing ram-plate at the end of a launch.

2. The detachable shock-absorbing ram-plate of claim 1 wherein said shock-absorbing ram-plate includes:

a cylinder defining a cavity;

a piston positioned within said cavity of said cylinder, said piston including at least one aperture extending therethrough; and a viscous fluid disposed in said cavity between said cylinder and said piston, wherein said viscous fluid is forced out of said at least one aperture in said piston when an initial launching impact force acts on said piston such that said piston and said cylinder are compressed.

3. The detachable shock-absorbing ram-plate of claim 2 wherein said cylinder and said piston are initially attached together with an adhesive, wherein said adhesive breaks as a result of said initial launching impact force.

4. The detachable shock-absorbing ram-plate of claim 2 wherein said piston has a tapered outer diameter.

5. The detachable shock-absorbing ram-plate of claim 3 wherein said piston has a tapered outer diameter.

6. The detachable shock-absorbing ram-plate of claim 2 wherein said viscous fluid is made of an inert substance.

7. The detachable shock-absorbing ram-plate of claim 1 wherein said shock-absorbing ram-plate includes a piece of elastic material.

8. The detachable shock-absorbing ram-plate of claim 1 wherein said shock-absorbing ram-plate includes:

a cylinder defining a cavity;

a piston positioned within said cavity of said cylinder; and a gas disposed in said cavity between said cylinder and said piston, wherein said piston compresses said gas upon receiving said launching impact forces.

9. The detachable shock-absorbing ram-plate of claim 1 wherein said fastener includes at least one of a snap, a pin, a screw, a bolt, and a cable.

10. A projectile launching system comprising:

a launch tube;

a projectile disposed in said launch tube;

a shock-absorbing ram-plate, wherein said shock-absorbing ram-plate compresses to absorb impact forces caused by launching; and a break-away fastener removably fastening said shock-absorbing ram-plate to a launch force applied end of the projectile, wherein said break-away fastener has strength sufficient to withstand said impact forces but insufficient to prevent detachment of said shock-absorbing ram-plate proximate an end of said launching tube.

11. The projectile launching system of claim 10 wherein said shock-absorbing ram-plate includes:

a cylinder defining a cavity;

a piston positioned within said cavity of said cylinder, said piston including at least one aperture extending therethrough; and a viscous fluid disposed in said cavity between said cylinder and said piston, wherein said viscous fluid is forced out of said at least one aperture in said piston when an initial impact force acts on said piston such that said piston and said cylinder are compressed.

12. The projectile launching system of claim 10 wherein said shock-absorbing ram-plate includes a piece of elastic material.

13. The projectile launching system of claim 10 wherein said shock-absorbing ram-plate includes:

a cylinder defining a cavity;

a piston positioned within said cavity of said cylinder; and a gas disposed in said cavity between said cylinder and said piston, wherein said piston compresses said gas upon receiving said impact forces.

14. The projectile launching system of claim 10 wherein said break-away fastener includes at least one of a snap, a pin, a screw, a bolt, and a cable.

15. The projectile launching system of claim 10 wherein said launch tube includes a stopping structure for stopping said shock-absorbing ram-plate proximate the end of said launch tube such that said break-away fastener fails causing said shock-absorbing ram-plate to remain in said launch tube while said projectile is launched.

* * * * *